US008617263B2

(12) United States Patent
Banerjee et al.

(10) Patent No.: US 8,617,263 B2
(45) Date of Patent: Dec. 31, 2013

(54) METHOD FOR PREPARING FUEL ELEMENT FOR SMOKING ARTICLE

(75) Inventors: Chandra Kumar Banerjee, Clemmons, NC (US); Stephen Benson Sears, Siler City, NC (US); Susan K Pike, Pilot Mountain, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 82 days.

(21) Appl. No.: 13/049,432

(22) Filed: Mar. 16, 2011

(65) Prior Publication Data

US 2011/0180082 A1 Jul. 28, 2011

Related U.S. Application Data

(63) Continuation of application No. PCT/US2009/057259, filed on Sep. 17, 2009, and a continuation-in-part of application No. 12/233,192, filed on Sep. 18, 2008, now Pat. No. 8,469,035.

(51) Int. Cl.
*C10L 5/00* (2006.01)

(52) U.S. Cl.
USPC ..... 44/550; 44/558; 44/580

(58) Field of Classification Search
USPC ..... 44/520, 522, 550, 521, 558, 580
See application file for complete search history.

(56) References Cited

U.S. PATENT DOCUMENTS 4,079,742 A 3/1978 Rainer et al.
4,714,082 A 12/1987 Banerjee et al.
4,756,318 A 7/1988 Clearman et al.
4,771,795 A 9/1988 White et al.
4,881,556 A 11/1989 Clearman et al.
4,989,619 A 2/1991 Clearman et al.
5,020,548 A 6/1991 Farrier et al.
5,027,837 A 7/1991 Clearman et al.
5,067,499 A 11/1991 Banerjee et al.
5,076,296 A 12/1991 Nystrom et al.
5,076,297 A 12/1991 Farrier et al.
5,099,861 A 3/1992 Clearman et al.
5,105,831 A 4/1992 Banerjee et al.
5,129,409 A 7/1992 White et al.
5,148,821 A 9/1992 Best et al.
5,156,170 A 10/1992 Clearman et al.
5,178,167 A 1/1993 Riggs et al.

(Continued)

FOREIGN PATENT DOCUMENTS

JP 10179112 * 7/1998
WO WO 02/37990 A2 5/2002

*Primary Examiner* — Cephia D Toomer
(74) *Attorney, Agent, or Firm* — Womble Carlyle Sandridge & Rice, LLP

(57) ABSTRACT

The invention provides a method for making a fuel element for a smoking article including the steps of mixing a metal-containing catalyst precursor with a filler material or graphite or a combination thereof to form a pre-treated fuel element component; optionally calcining the pre-treated fuel element component in order to convert the catalyst precursor to a catalytic metal compound; after the optional calcining step, combining the pre-treated fuel element component with a carbonaceous material and a binder to produce a fuel element composition; and forming the fuel element composition into a fuel element adapted for use in a smoking article. Examples of metal-containing catalyst precursors include iron nitrate, copper nitrate, cerium nitrate, cerium ammonium nitrate, manganese nitrate, magnesium nitrate, and zinc nitrate. Fuel elements treated according to the invention, and smoking articles including such fuel elements, are also provided.

24 Claims, 2 Drawing Sheets

(56) References Cited

U.S. PATENT DOCUMENTS

| | | | |
|---|---|---|---|
| 5,188,130 | A | 2/1993 | Hajaligol et al. |
| 5,211,684 | A | 5/1993 | Shannon et al. |
| 5,247,947 | A | 9/1993 | Clearman et al. |
| 5,345,955 | A | 9/1994 | Clearman et al. |
| 5,443,560 | A | 8/1995 | Deevi et al. |
| 5,468,266 | A | 11/1995 | Bensalem et al. |
| 5,469,871 | A | 11/1995 | Barnes et al. |
| 5,551,451 | A | 9/1996 | Riggs et al. |
| 5,560,376 | A | 10/1996 | Meiring et al. |
| 5,595,577 | A | 1/1997 | Bensalem et al. |
| 5,706,834 | A | 1/1998 | Meiring et al. |
| 5,727,571 | A | 3/1998 | Meiring et al. |
| 6,503,475 | B1 | 1/2003 | McCormick et al. |
| 6,799,578 | B2 | 10/2004 | Snaidr et al. |
| 6,874,508 | B2 | 4/2005 | Shafer et al. |
| 7,011,096 | B2 | 3/2006 | Li et al. |
| 7,569,510 | B2 | 8/2009 | Deevi et al. |
| 2002/0014453 | A1 | 2/2002 | Lilly, Jr. et al. |
| 2002/0167118 | A1 | 11/2002 | Billiet et al. |
| 2002/0172826 | A1 | 11/2002 | Yadav et al. |
| 2002/0194958 | A1 | 12/2002 | Lee et al. |
| 2003/0000538 | A1 | 1/2003 | Bereman |
| 2004/0250827 | A1 | 12/2004 | Deevi et al. |
| 2005/0066986 | A1 | 3/2005 | Nestor et al. |
| 2005/0166935 | A1 | 8/2005 | Reddy et al. |
| 2005/0274390 | A1 | 12/2005 | Banerjee et al. |
| 2006/0225753 | A1 | 10/2006 | Kaczmarek et al. |
| 2007/0215167 | A1 | 9/2007 | Llewellyn Crooks et al. |
| 2007/0215168 | A1 | 9/2007 | Banerjee et al. |

* cited by examiner

METHOD FOR PREPARING FUEL ELEMENT FOR SMOKING ARTICLE

CROSS-REFERENCE TO RELATED APPLICATIONS

This application is a continuation of International Application No. PCT/US2009/057259, filed Sep. 17, 2009, which International Application was published by the International Bureau in English on Mar. 25, 2010, and is a continuation-in-part of U.S. application Ser. No. 12/233,192, filed Sep. 18, 2008, now U.S. Pat. No. 8,469,035 both of which are incorporated by reference herein in their entirety.

FIELD OF THE INVENTION

The present invention relates to tobacco products, such as smoking articles (e.g., cigarettes).

BACKGROUND OF THE INVENTION

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod," "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Certain filter elements can incorporate polyhydric alcohols. See, for example, UK Pat. Spec. 755, 475. Certain cigarettes incorporate a filter element having multiple segments, and one of those segments can comprise activated charcoal particles. See, for example, U.S. Pat. Nos. 5,360,023 to Blakley et al. and 6,537,186 to Veluz. Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Through the years, there have been proposed various methods for altering the composition of mainstream tobacco smoke. In PCT Application Pub. No. WO 02/37990 to Bereman, it has been suggested that metallic particles and/or carbonaceous particles can be incorporated into the smokable material of a cigarette in an attempt to reduce the amounts of certain compounds in the smoke produced by that cigarette. In U.S. Patent Application Pub. No. 2005/0066986 to Nestor et al., it has been suggested that a tobacco rod can incorporate tobacco filler combined with an aerosol-forming material, such as glycerin. U.S. Pat. No. 6,874,508 to Shafer et al. proposes a cigarette having a paper wrapped tobacco rod having a tip portion that is treated with an additive, such as potassium bicarbonate, sodium chloride or potassium phosphate.

Various tobacco substitute materials have been proposed, and substantial listings of examples of such materials can be found in U.S. Pat. Nos. 4,079,742 to Rainer et al. and 4,771,795 to White et al. References describing tobacco substitutes are also set forth in the background section of U.S. Patent Application Pub. No. 2007/0215168 to Banerjee et al.

Numerous references have proposed various smoking articles of altered format and configuration, or of a type that generate flavored vapor, visible aerosol, or a mixture of flavored vapor and visible aerosol. See, for example, those references set forth in the background section of US 2007/0215168 to Banerjee et al. Furthermore, certain types of such smoking articles have been commercially marketed under the brand names "Premier" and "Eclipse" by R. J. Reynolds Tobacco Company, and under the brand name "Accord" by Philip Morris Inc. More recently, it has been suggested that the carbonaceous fuel elements of those types of cigarettes can incorporate ultrafine particles of metals and metal oxides. See, for example, US Pat. Application Pub. No. 2005/0274390 to Banerjee et al., which is incorporated by reference herein.

Smoking articles that employ tobacco substitute materials and smoking articles that employ sources of heat other than tobacco cut filler to produce tobacco-flavored vapors or tobacco-flavored visible aerosols have not received widespread commercial success. However, it would be highly desirable to provide a smoking article that demonstrates the ability to provide to a smoker many of the benefits and advantages of conventional cigarette smoking, while reducing delivery of incomplete combustion and pyrolysis products.

SUMMARY OF THE INVENTION

The invention provides a method for preparing a combustible, carbonaceous fuel element that incorporates a catalytic metal compound and which can be adapted for use in a smoking article. The catalytic metal compound can result in reduction of certain gas phase constituents of mainstream smoke during use of a smoking article that includes the catalyst-treated fuel element. In the present invention, rather than directly treating the fuel element with the catalytic metal compound, a metal-containing catalyst precursor capable of thermally decomposing into a catalytic metal compound is added to the fuel element. Upon heat treatment of the fuel element, the catalytic metal compound is formed as a result of thermal decomposition. The precursor compound may be converted to the active catalyst during pyrolysis/combustion of the fuel (i.e., at the time of use of the smoking article). Alternatively, the treated fuel may be subjected to a heat pre-treatment to facilitate the conversion.

Many catalytic metal compounds, especially metals and metal oxides, are insoluble in water (and many other common solvents) and are therefore difficult to process for uniform application to a fuel element. In contrast, many precursor compounds have a high solubility in water and other common solvents and can thus be incorporated into the fuel with greater ease. Additionally catalyst precursors may be less likely to deactivate as a result of environmental exposures.

In one embodiment, the method of the invention comprises forming a composition comprising a combustible carbonaceous material into a fuel element adapted for use in a smoking article; incorporating a metal-containing catalyst precursor into the fuel element or onto the surface thereof to form a treated fuel element, the incorporating step occurring before, during, or after said forming step; and optionally heating the treated fuel element at a temperature and for a time sufficient to convert the catalyst precursor to a catalytic metal compound. In cases where the treated fuel is not subjected to a heating treatment prior to incorporation into a smoking article, the thermal decomposition of the catalyst precursor may take place during combustion of the fuel element at the time of use of the smoking article.

The incorporating step can be accomplished by coating a formed fuel element (e.g., an extruded fuel element rod) with the catalyst precursor, which can be in the form of an aqueous solution, or by mixing the catalyst precursor into the fuel element composition prior to forming, such as by mixing the catalyst precursor with the carbonaceous material, a binder, and any optional ingredients like graphite, alumina, tobacco powder, and salts.

In certain embodiments, the incorporating step comprises mixing the metal-containing catalyst precursor with a filler material or graphite (or combination thereof) prior to the forming step to form a coated filler material or coated graphite. Thereafter, this treated material (i.e., the coated filler material or coated graphite) can be combined with the carbonaceous material and a binder to produce a fuel element composition prior to the forming step. Optionally, the treated material can be calcined in order to convert the catalyst precursor to a catalytic metal compound, either before or after mixing the treated material with the remaining portion of the fuel element composition.

The optional heating step will typically involve heating the treated fuel element at the decomposition temperature of the precursor compound, under an inert atmosphere (e.g., a nitrogen atmosphere); preferably for a period that ensures complete decomposition. Thermal treatment of the fuel element results in conversion of the catalyst precursor to an active catalytic metal compound, such as various oxides of metals including alkali metals, alkaline earth metals, transition metals in Groups IIIB, IVB, VB, VIB VIIB, VIIIB, IB, and IIB, Group IIIA elements, Group IVA elements, lanthanides, or actinides. The final catalytic metal compound will typically catalyze oxidation reactions such as the reaction of carbon monoxide to form carbon dioxide.

The metal-containing catalyst precursor is preferably in the form of a metal salt or an organic metal compound capable of thermal decomposition to a catalytic metal compound. Exemplary metal salts include citrates, nitrates, ammonium nitrates, sulfates, cyanates, hydrides, amides, thiolates, carbonates, and halides. In certain embodiments, the metal-containing catalyst precursor is iron nitrate, copper nitrate, cerium nitrate, cerium ammonium nitrate, manganese nitrate, magnesium nitrate, zinc nitrate, or a combination thereof. Treatment of the fuel element with the catalyst precursor can be combined with treatment with a second catalyst metal, such as a Group VIIIB metal compound (e.g., palladium, platinum, or rhodium, and halides or nitrates thereof).

In another embodiment, the invention provides a method for making a fuel element for a smoking article, comprising mixing a carbonaceous material, a binder, alumina or graphite, and a metal-containing catalyst precursor in the form of a metal salt to form a fuel element mixture; and forming the fuel element mixture into a combustible fuel element rod adapted for use in a smoking article. In a further embodiment, the treated rod is subjected to a heat treatment (e.g., in an inert atmosphere, and under time and temperature conditions sufficient to convert the catalyst precursor to a catalytic metal compound, such as a metal oxide). The heating step can involve, for example, heating the rod at a temperature of at least about 200° C. under an inert atmosphere. Optionally, the fuel element mixture could further include a Group VIIIB metal compound such as palladium, platinum, rhodium, or a halide or nitrate thereof.

According to any of the methods described above, the resulting treated fuel element can be incorporated into a smoking article. For example, the fuel element could be in the form of a rod having a size appropriate for introduction into a smoking article having the general dimensions associated with conventional smoking articles such as cigarettes.

In another aspect, the invention provides a fuel element for a smoking article prepared according to the methods set forth herein, such as a fuel element comprising a combustible carbonaceous material and a metal-containing catalyst precursor. For example, the catalyst precursor can be present in the form of a coating overlying at least a portion of the surface of the fuel element or dispersed throughout the carbonaceous material within the fuel element. In one embodiment, the metal-containing catalyst precursor is carried by particles of graphite or filler material (or both) within the fuel element.

Still further, the invention includes a smoking article comprising: a lighting end; a mouth end; and an aerosol-generation system, the aerosol generation system comprising an aerosol-generating segment and a heat generation segment, said heat generation segment including a fuel element, each segment being physically separate and in a heat exchange relationship, wherein the fuel element comprises a combustible carbonaceous material in intimate contact with a metal-containing catalyst precursor or a catalytic metal compound produced by thermal decomposition of the metal-containing catalyst precursor. The aerosol-generating segment may incorporate glycerin, propylene glycol, or a combination thereof.

BRIEF DESCRIPTION OF THE DRAWINGS

Figure 1:
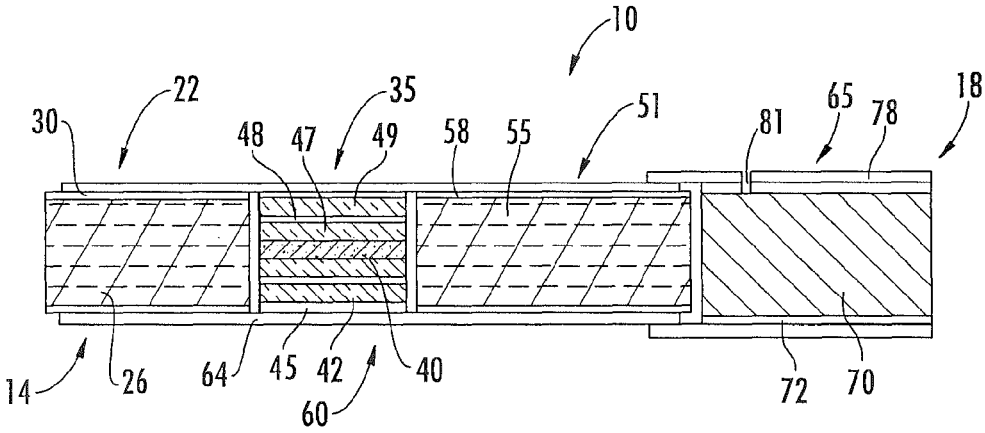
Figure 2:
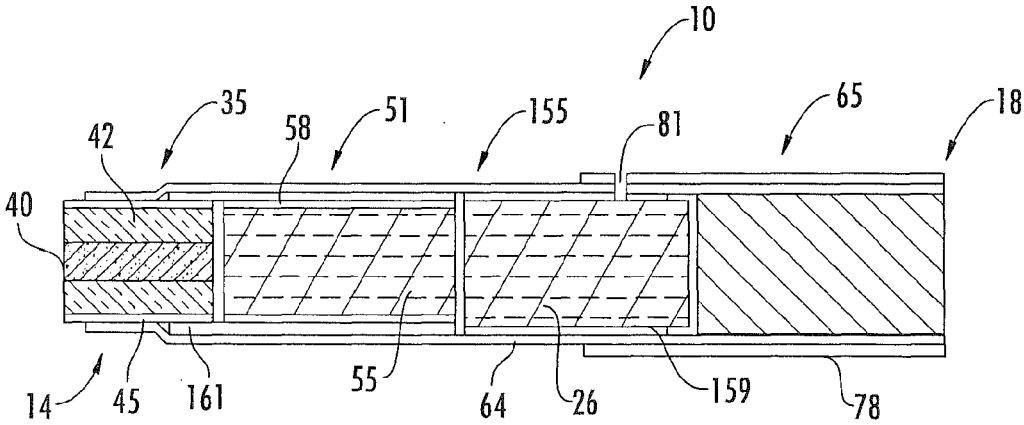
Figure 3:
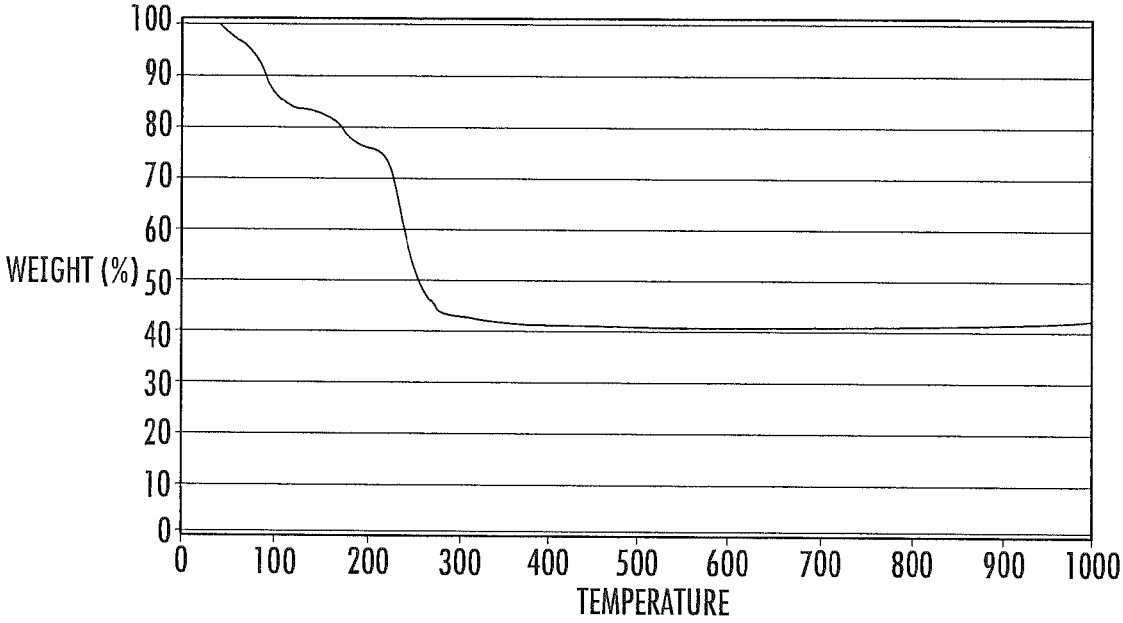

Having thus described the invention in general terms, reference will now be made to the accompanying drawings, which are not necessarily to scale, and wherein:

FIG. 1 provides a longitudinal cross-sectional view of a first smoking article representative of the present invention;

FIG. 2 provides a longitudinal cross-sectional view of a second smoking article representative of the present invention; and FIG. 3 provides a graph of the weight loss of a fuel element during heat treatment.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. Like components are given like numeric designations throughout the figures. As used in this specification and the claims, the singular forms "a," "an," and "the" include plural referents unless the context clearly dictates otherwise.

The invention provides a method of preparing a combustible fuel element (also referred to as a heat source herein) such that the fuel element includes a catalytic metal compound incorporated therein or thereon. The presence of the catalytic metal compound can reduce the concentration of certain gaseous components of mainstream smoke generated during use of a smoking article incorporating the fuel element. As used herein, "catalytic metal compound" refers to a metal-containing compound that can either directly react with one or more gas phase components of mainstream smoke generated by a smoking article or catalyze a reaction involving a gas phase component of mainstream smoke or both, such that concentration of the gas phase component is reduced. For example, certain catalytic metal compounds can catalyze the oxidation of CO to $CO_2$ in the presence of oxygen in order to reduce the level of CO in mainstream smoke (i.e., oxidation catalysts). In US 2007/0215168 to Banerjee et al., which is incorporated by reference herein in its entirety, smoking articles comprising fuel elements treated with cerium oxide particles are described. The cerium oxide particles reduce the amount of carbon monoxide emitted during use of smoking articles incorporating the treated fuel elements. Additional catalytic metal compounds are described in U.S. Pat. Nos. 6,503,475 to McCormick; 6,503,475 to McCormick, and 7,011,096 to Li et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; and 2005/0274390 to Banerjee et al., which are also incorporated by reference herein in their entirety.

Examples of the metal component of the catalytic metal compound include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn. Catalytic metal compounds can be used in a variety of solid particulate forms including precipitated metal particles, metal oxide particles (e.g., iron oxides, copper oxide, zinc oxide, and cerium oxide), and supported catalyst particles wherein the catalytic metal compound is dispersed within a porous supporting material. Combinations of catalytic metal compounds can be used, such as a combination of a palladium catalyst with cerium oxide. The particle size of the catalytic metal compounds can vary, but is typically between about 1 nm to about 1 micron.

The amount of catalytic metal compound incorporated into the fuel element can vary. For example, the amount thereof typically applied to, or incorporated within, a representative fuel element can range from about 0.1 mg to about 80 mg. Generally, that amount is at least about 1 mg, and often at least about 5 mg. Typically, the amount does not exceed about 50 mg, and often does not exceed about 25 mg. Frequently, the amount can be from about 5 mg to about 20 mg.

In the method of the invention, the fuel element is treated with a catalytic metal compound precursor (hereinafter referred to as a catalyst precursor), which is any precursor compound that thermally decomposes to form a catalytic metal compound. Exemplary catalyst precursors include metal salts (e.g., metal citrates, hydrides, thiolates, amides, nitrates, ammonium nitrates, carbonates, cyanates, sulfates, bromides, chlorides, as well as hydrates thereof) and metal organic compounds comprising a metal atom bonded to an organic radical (e.g., metal alkoxides, β-diketonates, carboxylates and oxalates). US 2007/0251658 to Gedevanishvili et al., which is incorporated by reference herein in its entirety, discloses a variety of catalyst precursors that can be used in the invention. Exemplary metal salts that can be used include iron nitrate, copper nitrate, cerium nitrate, cerium ammonium nitrate, manganese nitrate, magnesium nitrate, zinc nitrate, and the hydrates thereof. Combinations of multiple catalyst precursors or combinations of a catalyst precursor with a catalytic metal compound can be used to treat the fuel element. Where multiple catalyst precursors and/or catalytic metal compounds are used, the various components of the combination can be added to the fuel element together or separately.

As with the catalytic metal compound, the catalyst precursor can be in the form of a solid particulate material, which is optionally supported on a particulate substrate. Exemplary substrates include activated carbon, aluminum oxide, copper oxide, and titanium oxide. For example, the desired supporting substrate can be uniformly coated with a suspension of the catalyst precursor particles and dried in an oven. The amount of loading of the catalyst precursor onto the substrate can vary, but will typically be from about 0.2 percent to about 10.0 percent, based on the total dry weight of the coated substrate.

Following treatment of the fuel element with the catalyst precursor, the fuel element may be directly used in a smoking article. The conversion of the precursor to catalyst takes place during usage of the smoking article. Upon lighting, the temperature of the fuel element typically rises to more than 800° C. Part of the heat generated by the fuel is used to effect the conversion of the precursor to the catalyst compound.

Alternatively, the treated fuel element is subjected to a heat treatment in order to thermally decompose the catalyst precursor and form the desired catalytic metal compound, or subjected to microwave irradiation at an appropriate wavelength, intensity and duration to convert the catalyst precursor to a catalytic metal compound. The heat treatment step can proceed for a time and at a temperature sufficient to convert the catalyst precursor to the desired catalytic metal compound. In certain embodiments, this treatment step results in conversion of at least about 50% of the catalyst precursor molecules, typically at least about 75%, more often at least about 90%, and most often at least about 99% of the precursor molecules. The heat treatment step can be carried out in any commercially available furnace capable of controlling the rate of heating, the final temperature, the dwell time, and the atmosphere. The heat-treated fuel element can either be used immediately in a smoking article or stored for future use.

The temperature of the heat treatment step can vary. The treatment temperature primarily depends on the temperature of decomposition of the precursor. Precursors of lower decomposition temperature are generally preferred. The temperature typically ranges between about 100° C. and about 600° C., more often between about 150° C. and about 450° C., and most often between about 200° C. and about 400° C. The temperature is typically greater than about 100° C., often greater than about 150° C., and most often greater than about 200° C. The temperature is typically lower than about 550° C., often lower than about 500° C., and most often lower than about 450° C.

The length of the heat treatment step can vary, but is typically between about 0.25 hour and about 8 hours, more often between about 0.5 hour and about 6 hours, and most often between about 1 hour and about 5 hours. The heat treatment step typically lasts for at least about 1 hour, more often at least about 1.5 hours, and most often at least about 2 hours.

The heat treatment step typically occurs under an inert atmosphere, meaning an atmosphere or headspace that is substantially free of oxygen that could react with the carbon within the fuel element. Gases such as nitrogen, argon, and helium can be used.

The catalyst precursor can be applied to the fuel element in the form of a solid particulate material or in the form of a suspension or solution comprising a solvent. Solvents that may be used include water (e.g., deionized water), pentanes, hexanes, cyclohexanes, xylenes, mineral spirits, alcohols (e.g., methanol, ethanol, propanol, isopropanol and butanol), and mixtures thereof. Stabilizers, such as acetic acid, nitric acid, and certain organic compounds, can be added to the catalyst precursor suspensions or solutions. Applying the catalyst precursor to the fuel element as a suspension or solution can be advantageous because of the greater solubility of the catalyst precursors in water (and other common solvents) as compared to the catalyst compound. The greater solubility of the precursor results in active catalyst sites that tend to be more uniformly distributed throughout the fuel element in precursor-treated fuel elements as compared to a fuel element treated directly with the catalyst compound.

Treating the fuel element with the catalyst precursor can be accomplished by bringing the fuel element into intimate contact with catalyst precursor particles in a variety of ways, either before, during, or after configuring the fuel element into its final shape (e.g., the shape of a rod). The catalyst precursor particles are applied to, or incorporated within, the fuel element. The particles can be applied by spraying, co-extruding, or coating the fuel element. The particles can be mixed with fuel element components such that the particles are randomly or essentially homogeneously distributed within the fuel element or mixed with an ingredient that will be incorporated into the fuel element. For example, the particles can be mixed with particulate graphite or particulate non-burning filler material (e.g., alumina or calcium carbonate) or a mixture thereof prior to incorporation of the treated graphite or filler material into a fuel element composition. The particles also can be applied to, or incorporated within, insulation material of the insulation assembly that circumscribes the fuel element, or elsewhere within the smoking article (e.g., in a region downstream from the heat source). For example, the catalyst precursor particles can be applied to the glass mat of insulating material just prior to its contact with the fuel during manufacture.

The amount of catalyst precursor added to the fuel element will depend, at least in part, on the desired amount of catalytic metal compound in the fuel element. The amount of catalyst precursor typically applied to, or incorporated within, a representative fuel element can range from about 1 mg to about 200 mg. Generally, that amount is at least about 5 mg, and often at least about 10 mg. Typically, the amount does not exceed about 100 mg, and often does not exceed about 50 mg. Frequently, the amount can be from about 5 mg to about 20 mg.

Regarding the use of combinations of catalyst precursors and/or catalytic metal compounds, one exemplary combination is a combination of a catalyst precursor, such as cerium nitrate, with a Group VIIIB catalytic metal compound such as palladium, platinum, rhodium, halides thereof (e.g., palladium chloride or platinum chloride), or nitrates thereof (e.g., palladium nitrate or platinum nitrate). The two components can be separately applied to, or incorporated within, the fuel element. Alternatively, the two components can be added to the fuel element together, such as by addition of both components during mixing of the fuel element ingredients and prior to extrusion of the fuel element into its final form. Generally, the ratio between the amount of catalytic metal compound (e.g., Group VIIIB metal or metal halide) to the amount of catalyst precursor ranges from about 1:2 to about 1:10,000, on a weight basis. Typically the amount of catalytic metal compound per fuel element is between about 1 μg to about 100 mg, more often between about 10 μg to about 10 mg, most often between about 50 μg to about 1 mg.

In one embodiment, the fuel element is dip-coated with a suspension of the catalyst precursor particles. Dip-coating can be carried out in order to provide a uniform surface coating to the fuel element. In another embodiment, formed fuel elements can be surface treated with dry powdered particles or spray-coated with a suspension or solution. Alternatively, catalyst precursor particles can be contacted with fuel element extrudate immediately after the extrudate exits the extrusion die. Still further, the catalyst precursor particles, in dry powder form or in a solution or suspension form, can be mixed directly in a carbonaceous material mix along with other extrusion ingredients.

The fuel element can be provided in intimate contact with the catalyst precursor particles by concentrating the particle compositions in at least one longitudinal passageway or peripheral groove that extends at least partially through or along the length of the fuel element. For example, the fuel element can comprise an inner core/outer shell arrangement whereby the outer shell comprises a carbonaceous material surrounding the inner core of carbonaceous material, and the inner core comprises the catalyst precursor. Alternatively, for example, the fuel element can comprise one or more longitudinally-extending peripheral grooves incorporating the catalyst precursor.

One or more of the ingredients that will be mixed to form the fuel element can be pre-treated with the catalyst precursor particles prior to mixing with the remaining ingredients to form a fuel element composition. In one embodiment, graphite or a non-burning filler material (e.g., clay materials or calcium carbonate) or a combination thereof, preferably in particulate form, can be treated with the catalyst precursor by, for example, coating the particulate filler or graphite material with a liquid suspension or solution comprising the catalyst precursor or by mixing solid catalyst precursor particles with the particulate filler or graphite material. The treated filler or graphite material can be calcined to convert the catalyst precursor into a catalytic metal compound as described herein, either before or after mixing the pre-treated material with the remaining ingredients of the fuel element composition, or even after formation of the fuel element. Alternatively, no calcination step can take place during the fuel element manufacturing process and, instead, conversion into the catalytic metal compound can occur during combustion of the fuel element. Pre-treatment of a fuel element composition ingredient, such as graphite or a filler, with the catalyst precursor can also be optionally accompanied by pre-treatment with a Group VIIIB metal compound at the same time.

Typically, the fuel elements that are treated in the present invention comprise a combustible carbonaceous material such as milled carbon powder. Preferred carbonaceous materials are composed predominantly of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials of the type described above. Exemplary additional ingredients include tobacco components, such as powdered tobaccos or tobacco extracts; flavoring agents; salts, such as sodium chloride, potassium chloride and sodium carbonate; non-burning filler materials such as calcium carbonate, sodium carbonate, clays such as bentonite, glass filaments, or alumina; heat stable graphite fibers; ammonia sources, such as ammonia salts; and/or binding agents, such as guar gum, ammonium alginate and sodium alginate. A representative fuel element has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel element components, formulations, and designs set forth in U.S. Pat. No. 5,551,451 to Riggs et al., which is incorporated by reference herein in its entirety.

The amount of combustible carbonaceous material incorporated into a fuel element can provide at least about 50 percent, often at least about 60 percent, and frequently at least about 70 percent, of the weight of a fuel element, on a dry weight basis. In some embodiments, fuel elements can incorporate up to about 15 weight percent, frequently up to about 10 weight percent binding agent; up to about 15 weight percent, frequently up to about 10 weight percent of additive ingredients such as tobacco powder, salts, and the like; up to about 20 weight percent, frequently up to about 15 weight percent, of ingredients such as graphite or alumina; and at least about 50 weight percent, frequently at least about 65 weight percent, of a high carbon content carbonaceous material. However, in some embodiments, fuel elements can be absent of the amount of sodium set forth in U.S. Pat. No. 5,178,167 to Riggs et al.; and/or the amounts of graphite and/or calcium carbonate set forth in U.S. Pat. No. 5,551,451 to Riggs et al. In some embodiments, fuel elements incorporate about 10 to about 20 weight parts of ingredients such as graphite or alumina, and about 60 to about 75 weight parts of combustible carbonaceous material. For example, a representative fuel element can possess about 66.5 percent carbonaceous material, about 18.5 percent graphite, about 5 percent tobacco parts, about 10 percent guar gum and about 1 percent sodium carbonate, on a dry weight basis.

As noted above, the catalyst precursor, in dry powder form or in a solution or suspension, may be mixed directly in a carbon mix along with other fuel element ingredients prior to extrusion. See, e.g., the components and techniques described in US 2005/0274390 to Banerjee et al. and US 2007/0215168 to Banerjee et al., both of which are incorporated by reference herein in their entireties.

Fuel elements can possess, or be absent of, longitudinally extending peripheral surface grooves; and such a fuel element can possess, or be absent of at least one centrally located, longitudinally extending air passageway. Certain fuel elements can have a generally tubular shape; having a relatively large diameter central passageway and no peripherally extending grooves. For example, those fuel elements do not possess the types of formats and configurations set forth in U.S. Pat. No. 4,989,619 to Clearman et al. Certain fuel elements have longitudinally extending peripheral grooves, and the grooves can have cross-section shapes of semi-circular, triangular or rectangular, or such that the overall cross-sectional shape of the fuel element can be characterized as generally "snow flake" in nature. Certain other fuel elements may have a surface that includes no grooves while optionally including a central passageway. Yet other fuel elements may have a surface that includes no grooves and are substantially solid (e.g., not having any central passageway), as for example, a cylindrical shaped fuel element.

Suitable fuel elements, and representative components, designs and configurations thereof, and manners and methods for producing those fuel elements and the components thereof, are set forth in U.S. Pat. Nos. 4,714,082 to Banerjee et al.; 4,756,318 to Clearman et al.; 4,881,556 to Clearman et al.; 4,989,619 to Clearman et al.; 5,020,548 to Farrier et al.; 5,027,837 to Clearman et al.; 5,067,499 to Banerjee et al.; 5,076,297 to Farrier et al.; 5,099,861 to Clearman et al.; 5,105,831 to Banerjee et al.; 5,129,409 to White et al.; 5,148,821 to Best et al.; 5,156,170 to Clearman et al.; 5,178,167 to Riggs et al.; 5,211,684 to Shannon et al.; 5,247,947 to Clearman et al.; 5,345,955 to Clearman et al.; 5,469,871 to Barnes et al.; 5,551,451 to Riggs; 5,560,376 to Meiring et al.; 5,706,834 to Meiring et al.; and 5,727,571 to Meiring et al.; which are incorporated herein by reference in their entirety. Exemplary carbonaceous fuel elements include those that have been incorporated within those cigarettes commercially marketed under the trade names "Premier" and "Eclipse" by R. J. Reynolds Tobacco Company.

The fuel element can be formed into the desired shape by techniques such as compression, pressing, or extrusion. For example, a moist, dough-like paste can be extruded using single screw or twin screw extruder, such as an extruder having a stainless steel barrel and screw, an inner sleeve constructed from a highly wear resistant and corrosion resistant ceramic material, and a ceramic die. Exemplary types of extrusion devices include those types available as ICMA San Giorgio Model No. 70-16D or as Welding Engineers Model No. 70-16LD. For an extruded fuel element containing a relatively high level of carbonaceous material, the density of the fuel element can be decreased slightly by increasing the moisture level within the extruded mixture, decreasing the die pressure within the extruder, or incorporating relatively low density materials within the extruded mixture.

The fuel element prepared according to the method of the invention can be utilized in a variety of smoking articles, such as any of the smoking articles set forth in US 2007/0215167 to Crooks et al. or US 2007/0215168 to Banerjee et al., which are incorporated by reference herein. Referring to FIG. 1, a representative smoking article 10 in the form of a cigarette is shown. The smoking article 10 has a rod-like shape, and includes a lighting end 14 and a mouth end 18. For the various figures, the thicknesses of the various wrapping materials and overwraps of the various smoking articles and smoking article components are exaggerated. Most preferably, wrapping materials and overwrap components are tightly wrapped around the smoking articles and smoking article components to provide a tight fit, and provide an aesthetically pleasing appearance.

At the lighting end 14 is positioned a longitudinally extending, generally cylindrical smokable lighting end segment 22 incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 incorporates a heat source or fuel element 40, which typically has a generally cylindrical shape, circumscribed by insulation 42, which is coaxially encircled by wrapping material 45. In some embodiments, each heat source segment 35 incorporates a one piece fuel element 40, and only one fuel element is incorporated into each heat source segment.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. Preferably, both ends of the heat generation segment 35 are open to expose the heat source 40 and insulation 42 to the adjacent segments. The heat source 40 and the insulation 42 around it can be configured so that the length of both materials is co-extensive (i.e., the ends of the insulating jacket 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, smoke produced when the smokable lighting end segment 22 is burned during use of the smoking article 10 can readily pass through the heat generation segment 35 during draw by the smoker on the mouth end 18.

The heat generation segment 35 is positioned adjacent to the downstream end of the smokable lighting end segment 22 such that those segments are axially aligned in an end-to-end relationship, preferably abutting one another. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical cigarette having a circumference of about 24 mm to about 26 mm, a representative heat source 40 has a generally circular cross-sectional shape with an outer diameter of about 2.5 mm to about 5 mm, often about 3 mm to about 4.5 mm.

Located downstream from the heat generation segment 35 is a longitudinally extending, cylindrical aerosol-generating segment 51. The aerosol-generating segment 51 incorporates a substrate material 55 that, in turn, acts as a carrier for an aerosol-forming agent or material (not shown). For example, the aerosol-generating segment 51 can possess a reconstituted tobacco material that incorporates processing aids, flavoring agents, and glycerin.

A representative wrapping material 58 for the substrate material 55 can possess heat conductive properties, and can have the form of a metal or metal foil (e.g., aluminum) tube, or a laminated material having an outer surface comprised of paper and an inner surface comprised of metal foil. For example, the metal foil can conduct heat from the heat generation segment 35 to the aerosol-generating segment 51, in order to provide for the volatilization of the aerosol forming components contained therein.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. That tobacco, in turn, can be treated with, or processed to incorporate, aerosol-forming material and/or at least one flavoring agent.

The aerosol-generating segment 51 and the heat generation segment 35 can be configured in a heat exchange relationship with one another. The heat exchange relationship is such that sufficient heat from the heat source is supplied to the aerosol-formation region to volatilize aerosol-forming material for aerosol-formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51.

For preferred smoking articles, both ends of the aerosol-generating segment 51 are open to expose the substrate material 55 thereof. Components of the aerosol produced by burning the smokable lighting end segment 22 during use of the smoking article can readily pass through the aerosol-generating segment 51 during draw on the mouth end 18.

Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. That is, those segments are physically separate relative to one another. Those segments can abut one another, or be positioned in a slightly spaced apart relationship. The outer cross-sectional shapes and dimensions of those segments, when viewed transversely to the longitudinal axis of the smoking article 10, can be essentially identical to one another. The physical arrangement of those components is such that heat is transferred (e.g., by means that includes conductive and convective heat transfer) from the heat source 40 to the adjacent substrate material 55, throughout the time that the heat source is activated (e.g., burned) during use of the smoking article 10.

The components of the aerosol-generation system 60 and the lighting end segment 22 are attached to one another, and secured in place, using an overwrap material 64. For example, a paper wrapping material or a laminated paper-type material circumscribes each of the heat generation segment 35, at least a portion of outer longitudinally extending surface of the aerosol-generating segment 51, and at least a portion of an the lighting end segment 22 that is adjacent to the heat generation segment. The inner surface of the overwrap material 64 is secured to the outer surface of the outer wrapping material 45 of the heat generation segment 35, the outer surface of the outer wrapping material 58 of the aerosol-generating segment 51, and the outer surface of the outer wrapping material 30 of the lighting end segment 22, using a suitable adhesive.

The smoking article 10 further comprises a suitable mouthpiece such as, for example, a filter element 65, positioned at the mouth end 18 thereof. The filter element 65 preferably has the form of a traditional type of cigarette filter element. The filter element 65 is positioned at one end of the cigarette rod adjacent to one end of the aerosol-generating segment 51, such that the filter element and aerosol-generating segment 51 are axially aligned in an end-to-end relationship, abutting one another. Preferably, the general cross-sectional shapes and dimensions of those segments 51, 65 are essentially identical to one another when viewed transversely to the longitudinal axis of the smoking article. The filter element 65 incorporates filter material 70 (e.g., plasticized cellulose acetate tow) that is overwrapped along the longitudinally extending surface thereof with circumscribing plug wrap material 72. Both ends of the filter element 65 are open to permit the passage of aerosol therethrough.

The aerosol-generating system 60 is attached to filter element 65 using tipping material 78. The tipping material 78 circumscribes both the entire length of the filter element 65 and an adjacent region of the aerosol-generation system 60. The inner surface of the tipping material 78 can be secured to the outer surface of the plug wrap 72 and the outer surface of the cigarette rod overwrap or outer wrapping material 64 of the aerosol-generation system 60, using a suitable adhesive. As such, any region of the aerosol-generation system not covered by the overwrap is covered by the tipping material, and is not readily visible. The overwrap material 64 can extend over the entire length of the aerosol-generating segment, or as is shown in FIG. 1, slightly recessed from the extreme lighting end of that segment (e.g., a sufficient distance from the end of that segment so that the tipping material overlies the region of the cigarette rod that is not covered by the overwrap). As such, there is provided an aesthetically pleasing cigarette rod that appears to possess a single layer overwrap. In addition, there is provided an aesthetically pleasing filtered cigarette that possesses a filter element tipped to a cigarette rod that appears to possess a single layer overwrap.

The smoking article can include an air dilution means, such as a series of perforations 81, each of which extend through the filter element tipping material 78 and plug wrap material 72.

The amount of smokable material 26 employed to manufacture the smokable lighting end segment 22 can vary. Typically, a smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. Typically, a smokable lighting end segment, manufactured predominantly from tobacco cut filler, includes up to about 400 mg, generally up to about 350 mg, often up to about 300 mg, and frequently up to about 250 mg, of tobacco material, on a dry weight basis. Certain smokable lighting end segments manufactured predominantly from tobacco cut filler may include less than about 85 mg, often less than about 60 mg, and even less than about 30 mg, of tobacco material, on a dry weight basis. The packing density of the smokable material within the smokable lighting end segment, typically is less than the density of the fuel element. When the smokable material has the form of cut filler, the packing density of the smokable material within the smokable lighting end segment is less than about 400 mg/cm$^3$, and generally less than about 350 mg/cm$^3$; while the packing density of the tobacco material within the smokable lighting end segment can exceed about 100 mg/cm$^3$, often exceeds about 150 mg/cm$^3$, and frequently exceeds about 200 mg/cm$^3$. Preferably, the smokable lighting end segment 22 is composed entirely of smokable material, and does not include a carbonaceous fuel element component.

The combined amount of aerosol-forming agent and substrate material 55 employed in the aerosol-generating segment 51 can vary. The material normally is employed so as to fill the appropriate section of the aerosol-generating segment 51 (e.g., the region within the wrapping material 58 thereof) at a packing density of less than about 400 mg/cm$^3$, and generally less than about 350 mg/cm$^3$; while the packing density of the aerosol-generating segment 51 generally exceeds about 100 mg/cm$^3$, and often exceeds about 150 mg/cm$^3$.

During use, the smoker lights the lighting end 14 of the smoking article 10 using a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler. The smokable material 26 and outer wrapping material 30 of the smokable lighting end segment burn down, essentially as is the case for a traditional tobacco burning cigarette. Ash and charred materials that result as the resulting hot coal passes downstream from the lighting end can be flicked, or otherwise removed from the cigarette, essentially in the manner that ash generated from burned tobacco cut filler is removed from a traditional type of tobacco burning cigarette.

Burning of the smokable lighting end segment 22 causes the heat source 40 of the heat generation segment 35, which can be positioned downstream from the smokable lighting end segment 22, to be heated. Thus, the heat source 40 is ignited or otherwise activated (e.g., begins to burn) thereby generating heat. The heat source 40 within the aerosol-generation system 60 is burned, and provided heat to volatilize aerosol-forming material within the aerosol-generating segment 51, as a result of the heat exchange relationship between those two regions or segments. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed is drawn through the filter element 65, and into the mouth of the smoker.

During certain periods of use, aerosol formed within the aerosol-generating segment 51 is drawn through the filter element 65 and into the mouth of the smoker, along with the aerosol (i.e., smoke) formed as a result of the thermal degradation of the smokable material within the lighting segment 22. Thus, the mainstream aerosol produced by the smoking article 10 includes tobacco smoke produced by the thermal decomposition of the tobacco cut filler as well as volatilized aerosol-forming material. For early puffs (i.e., during and shortly after lighting), most of the mainstream aerosol results from thermal decomposition of the smokable lighting end segment 22, and hence contains thermal decomposition products of the smokable material 26. For later puffs (i.e., after the smokable lighting end segment has been consumed and the heat source of the aerosol-generation system has been ignited), most of the mainstream aerosol that is provided is produced by the aerosol-generation system 60. The smoker can smoke a smoking article for a desired number of puffs. However, when the smokable material 26 has been consumed, and the heat source 40 extinguishes, the use of the smoking article is ceased (i.e., the smoking experience is finished).

Typically, the lighting end segment can be manufactured by providing a "two-up" lighting end segment, aligning a heat source segment at each end of the "two-up" segment, and wrapping the aligned components to provide a "two-up" combined segment. That "two-up" combined segment then is cut in half perpendicular to its longitudinal axis to provide two combined segments. Alternatively, two segments can be aligned and wrapped to provide a combined segment.

Typically, the mouth end segment can be provided by connecting the aerosol-generating segment to each end of the "two-up" filter element segment to provide a "two-up" combined segment; and subdividing the "two-up" combined segment to provide two combined mouth end segments. Alternatively, that combined segment can be provided by connecting a filter element segment to each end of a "two-up" aerosol-generating segment to provide a "two-up" combined segment; and subdividing the "two-up" combined segment to provide two combined mouth end segments.

Referring to FIG. 2, a second representative smoking article 10 in the form of a cigarette is shown. The cigarette 10 includes a heat generation segment 35 located at the lighting end 14, a filter segment 65 located at the mouth end 18, an aerosol-formation segment 51 located adjacent to the heat generation segment, and tobacco-containing segment 155 located adjacent to the filter element 65. If desired, the tobacco-containing segment can be a multi-component segment that has been combined to form a single component piece. The compositions, formats, arrangements and dimensions of the various segments of the smoking article 10 can be generally similar to those incorporated within those cigarettes commercially marketed under the trade name "Eclipse" by R. J. Reynolds Tobacco Company. The tobacco-containing segment 155 possesses tobacco and/or tobacco flavor generating material (e.g., tobacco cut filler, processed tobacco cut filler, strips of tobacco material, a gathered web of reconstituted tobacco material, or the like). That segment can possess a circumscribing wrapper 159, such as a paper wrapping material.

The heat source segment 35 is attached and secured to the aerosol-generating segment 51 using a wrapping material 161 that circumscribes at least a portion of the length of heat source segment (e.g., that portion of the segment immediately adjacent to the aerosol-generating segment), and at least a portion of the length of the aerosol-generating segment (e.g., that portion of the immediately adjacent to the heat generation segment). If desired, the wrapping material can circumscribe the entire lengths of either or both of the aerosol-generating and heat generation segments. Most preferably, the wrapping material 161 that is used to combine the heat generation segment to the aerosol-generating segment is a laminate of paper and metal foil (i.e., a material that can be used to conduct heat from the heat generation segment to the aerosol-generating segment).

The combined heat generation segment 35 and aerosol-generating segment 51 is attached and secured to the tobacco-containing segment 155 using a wrapping material 64 that circumscribes at least a portion of the length of heat generation segment 35 (e.g., the portion of that segment immediately adjacent to the aerosol-generating segment), the aerosol-generating segment 51, and at least a portion of the length of the tobacco-containing segment 155 (e.g., the portion of that segment immediately adjacent to the filter element). If desired, the wrapping material can circumscribe the entire lengths of either or both of the tobacco-containing and heat generation segments. The combination of the three segments using the single overwrap material provides a cigarette rod.

A filter element 65 is attached to the cigarette rod so formed using a tipping material 78, in the general manner set forth previously with reference to FIG. 1. The smoking article optionally can be air-diluted by providing appropriate perforations 81 in the vicinity of the mouth end region 18.

The foregoing components can be combined by providing two heat generation segments, and aligning those segments at each end of a "two-up" aerosol-generating segment. An exemplary "two-up" aerosol-generating segment can have a length of about 40 mm to about 45 mm, preferably about 21 mm. The three segments are combined using a tipping type of apparatus, such as a device available as MAX S. Those segments then can be stored, dried, re-ordered, or used directly in further manufacturing steps. The "two-up" segment is cut in half, perpendicular to its longitudinal axis, using a suitable dividing knife, to provide two combined segments. The segments can be spread apart from one another, and a "two-up" tobacco containing segment can be positioned between those two combined segments. The resulting three aligned segments are combined using a tipping type of apparatus, such as a device available as MAX S. For example, a tipping paper having a width of about 90 mm can be used to combine those segments together. The resulting "two-up" cigarette rod segment is cut in half, perpendicular to its longitudinal axis, to provide two cigarette rods. Those rods can be collected, or turned and collected in an appropriate reservoir. The individual cigarette rods can be fed into the hopper of a tipping type of apparatus, such as a device available as MAX S.

Smokable lighting end segments, heat generation segments, the aerosol-generating segments, tobacco-containing segments, mouth end pieces, and various components of the foregoing, can be manufactured using conventional types of cigarette and cigarette component manufacturing techniques and equipment, or appropriately modified cigarette and cigarette component manufacturing equipment. That is, the various component parts and pieces can be processed and assembled into cigarettes using the conventional types of technologies known to those skilled in the art of the design and manufacture of cigarettes and cigarette components, and in the art of cigarette component assembly. See, for example, the types of component configurations, component materials, assembly methodologies and assembly technologies set forth in U.S. Pat. Nos. 5,052,413 to Baker et al.; 5,088,507 to Baker et al.; 5,105,838 to White et al.; 5,469,871 to Barnes et al.; and 5,551,451 to Riggs et al.; and US Pat. Publication No. 2005/0066986 to Nestor et al., which are incorporated herein by reference in their entireties.

The manufacture of multi-segment components can be carried out using combination equipment of the type available under the brand name Mulfi or Merlin from Hauni Maschinenbau A G of Hamburg, Germany; or as LKF-01 Laboratory Multi Filter Maker from Heinrich Burghart GmbH. Combination of various segments or cigarette components also can be carried out using conventional-type or suitably modified devices, such as tipping devices available as Lab MAX, MAX, MAX S or MAX 80 banding devices from Hauni Maschinenbau A G. That is, rods, segments and combined segments can be fed (e.g., using trays, hoppers, wheels, and the like), aligned, tipped or otherwise connected, subdivided, turned, conveyed, separated and collected (e.g., using frays, belts, hoppers, and the like) using appropriately modified and arranged tipping devices. See, for example, the types of devices and combination techniques set forth in U.S. Pat. Nos. 3,308,600 to Erdmann et al.; 4,280, 187 to Reuland et al.; 4,281,670 to Heitmann et al.; and 6,229,115 to Vos et al.; and US Pat. Publication. No. 2005/0194014 to Read, Jr.

The types of materials and configurations utilized for smokable materials, insulation materials, aerosol-forming materials, flavoring agents, wrapping materials, mouth end pieces (e.g., filter elements), plug wraps, and tipping materials in the smoking articles of the invention can vary. Embodiments of such smoking article components are set forth in US 2007/0215167 to Crooks et al. and US 2007/0215168 to Banerjee et al.

For cigarettes of the present invention that are air-diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. In some embodiments, the upper level for air dilution for an air-diluted cigarette is less than about 80 percent, and often is less than about 70 percent. As used herein, the term "air dilution" is the ratio (expressed as a percentage) of the volume of air drawn through the air dilution means to the total volume of air and aerosol drawn through the cigarette and exiting the mouth end portion of the cigarette. Higher air dilution levels can act to reduce the transfer efficiency of aerosol-forming material into mainstream aerosol.

In some embodiments, cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180 mm, and, in some embodiments, between about 70 mm to about 150 mm, water pressure drop at 17.5 cc/sec. air flow. Pressure drop values of cigarettes are measured using a Filtrona Cigarette Test Station (CTS Series) available form Filtrona Instruments and Automation Ltd.

Preferred embodiments of cigarettes of the present invention, when smoked, yield an acceptable number of puffs. Such cigarettes normally provide more than about 6 puffs, and generally more than about 8 puffs, per cigarette, when machine smoked under FTC smoking conditions. Such cigarettes normally provide less than about 15 puffs, and generally less than about 12 puffs, per cigarette, when smoked under FTC smoking conditions. FTC smoking conditions consist of 35 ml puffs of 2 second duration separated by 58 seconds of smolder.

Cigarettes of the present invention, when smoked, yield mainstream aerosol. The amount of mainstream aerosol that is yielded per cigarette can vary. When smoked under FTC smoking conditions, a cigarette, according to one embodiment, yields an amount of FTC "tar" that normally is at least about 1 mg, often is at least about 3 mg, and frequently is at least about 5 mg. When smoked under FTC smoking conditions, an exemplary cigarette yields an amount of FTC "tar" that normally does not exceed about 20 mg, often does not exceed about 15 mg, and frequently does not exceed about 12 mg.

A preferred cigarette exhibits a ratio of yield of FTC "tar" to FTC nicotine of less than about 30, and often less than about 25. A preferred cigarette exhibits a ratio of yield of FTC "tar" to FTC nicotine of more than about 5. A cigarette (e.g., a cigarette including a carbonaceous fuel element absent of a centrally or internally located longitudinally extending air passageway) exhibits a ratio of yield of FTC carbon monoxide to FTC "tar" of less than about 1, often less than about 0.8, and frequently less than about 0.6. Techniques for determining FTC "tar" and FTC nicotine are set forth in Pillsbury et al., J. Assoc. Off. Anal. Chem., 52, 458-462 (1969). Techniques for determining FTC carbon monoxide are set forth in Horton et al., J. Assoc. Off. Anal. Chem., 57, 1-7 (1974).

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis. Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components have a tendency not to undergo a significant degree of thermal decomposition (e.g., as a result of combustion, smoldering or pyrolysis) during conditions of normal use.

Smoking articles of the present invention can be packaged for distribution, sale and use. Cigarettes can be packaged in the manner used for those cigarettes commercially marketed under the trade names "Premier" and "Eclipse" by R. J. Reynolds Tobacco Company. Cigarettes also can be packaged in the manner used for those cigarettes commercially marketed under the trade name Camel Blackjack Gin by R. J. Reynolds Tobacco Company. Cigarettes also can be packaged in the manner used for those cigarettes commercially marketed under the trade name Salem Dark Currents Silver Label by R. J. Reynolds Tobacco Company. See, also, the types of packages set forth in U.S. Pat. Nos. 4,715,497 to Focke et al.; 4,294,353 to Focke et al.; 4,534,463 to Bouchard; 4,852,734 to Allen et al.; 5,139,140 to Burrows et al.; and 5,938,018 to Keaveney et al.; UK Pat. Spec. 1,042,000; German Pat. App. DE 10238906 to Marx; and US Pat. Publication Nos. 2004/0217023 to Fagg et al.; 2004/0256253 to Henson et al.; and 2005/0150786 to Mitten et al.

In another aspect of the invention, a tobacco material is treated with the metal-containing catalyst precursor of the type described herein. Thereafter, the tobacco material can be incorporated into a smoking article, optionally after being subjected to a heat/irradiation treatment as described herein in order to convert the precursor to the desired catalyst. If the tobacco is not pre-treated to convert the precursor, conversion will occur during combustion of the tobacco material during use of the smoking article.

The treated tobacco material could then be incorporated into any type of smoking article, including conventional cigarettes or the type of smoking articles described herein. The catalyst precursor could be applied to the tobacco using any of the techniques described herein, such as spray-coating, dip-coating, mixing, and the like.

The tobacco material to which the catalyst precursor is applied can be used in forms, and in manners, that are traditional for the manufacture of smoking articles, such as cigarettes. Those materials can incorporate shredded pieces of tobacco (e.g., lamina and/or stem), and/or those materials can be tobacco materials that are in processed forms. For example, those materials normally are used in cut filler form (e.g., shreds or strands of tobacco filler cut into widths of about 1/10 inch to about 1/60 inch, or about 1/20 inch to about 1/35 inch, and in lengths of about 1/8 inch to about 3 inches, usually about 1/4 inch to about 1 inch). Alternatively, though less preferred, those materials, such as processed tobacco materials, can be employed as longitudinally extending strands or as sheets formed into the desired configuration, or as compressed or extruded pieces formed into a desired shape.

Tobacco materials can include, or can be derived from, various types of tobaccos, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in Tobacco Production, Chemistry and Technology, Davis et al. (Eds.) (1999). See, also, U.S. Patent Application Pub. No. 2004/0084056 to Lawson et al. In some embodiments, the tobacco materials are those that have been appropriately cured and aged.

Tobacco materials can be used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have processed forms, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, recyclable pieces of tobacco and tobacco dust can be used to manufacture processed reconstituted tobaccos of fairly uniform consistency. The precise amount of each type of tobacco within a tobacco blend used for the manufacture of a particular cigarette brand can vary, and is a manner of design choice, depending upon factors such as the sensory characteristics desired. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999). Various representative tobacco types, processed types of tobaccos, types of tobacco blends, cigarette components and ingredients, and tobacco rod configurations, also are set forth in U.S. Pat. Nos. 4,836,224 to Lawson et al.; 4,924,883 to Perfetti et al.; 4,924,888 to Perfetti et al.; 5,056,537 to Brown et al.; 5,159,942 to Brinkley et al.; 5,220,930 to Gentry; 5,360,023 to Blakley et al.; 5,715,844 to Young et al.; and 6,730,832 to Dominguez et al.; U.S. Patent Application Pub. Nos. 2002/0000235 to Shafer et al.; 2003/0075193 to Li et al.; 2003/0131859 to Li et al.; 2004/0084056 to Lawson et al.; 2004/0255965 to Perfetti et al.; and 2005/0066986 to Nestor et al.; PCT Application Pub. No. WO 02/37990 to Bereman; and Bombick et al., Fund. Appl. Toxicol., 39, p. 11-17 (1997); which are incorporated herein by reference.

EXPERIMENTAL

The present invention is more fully illustrated by the following examples, which are set forth to illustrate the present invention and are not to be construed as limiting thereof.

Example 1

Fuel elements from ECLIPSE brand cigarettes are carefully removed without disturbing the surrounding glass mat. The ECLIPSE fuel elements are coated with an aqueous solution of cerium nitrate hexahydrate (50% w/w) and dried overnight at 110° C. A control batch of fuel elements are treated with water only.

The treated fuel elements are subjected to a heat treatment under nitrogen pressure in a programmable Barnstead THERMOLYNE 62700 furnace. The fuel elements are heated to 400° C. at a ramp rate of 5° C. per minute and held for four hours. The minimum temperature at which a complete conversion of cerium nitrate hexahydrate to ceria takes place is determined by thermogravimetric analysis (TGA) using Model STA409 PC analyzer from Netzsch Instruments, Inc.

The thermal transition takes place in four distinct stages, which can be seen in FIG. 3. Loss of water of crystallization (219% weight) takes place between 57° C. and 200° C. Decomposition of cerium nitrate to cerium oxide (35.3% weight loss) takes place between 200° C. and 378° C. The loss of water of crystallization is permanent and the cerium oxide does not regain the water. It is believed that this treatment results in a complete conversion of the nitrate to oxide.

The fuels are equilibrated under ambient conditions and reinserted into a cigarette similar in construction to an ECLIPSE cigarette. The cigarettes are smoked under 50/30/2 smoking conditions (i.e., 50 ml puffs of 2 second duration separated by 28 seconds); and CO in the mainstream is measured by nondispersive infrared spectroscopy (NDIR) using NGA 2000 from Rosemount Inc. Treatment of the fuel with cerium nitrate, followed by heat treatment of the fuel, resulted in a 53% reduction of mainstream CO as compared to the control.

Example 2

The fuel element treatment process of Example 1 is repeated using the following catalyst precursors: cerium nitrate, copper nitrate, potassium nitrate, and cerium nitrate combined with palladium. The treated fuels are not subjected to heat treatment prior to combustion in the smoking article. The resulting cigarettes are smoked under 50/30/2 smoking conditions; and CO in the mainstream is measured by NDIR. Treatment of the fuel with cerium nitrate, copper nitrate, potassium nitrate or cerium nitrate/palladium chloride results in a CO reduction of 73.8%, 272%, 16.3% or 84.7%, respectively, as compared to the untreated control.

Example 3

About 15 grams of cerium (III) nitrate hexahydrate (Alfa Aesar) or copper (II) nitrate hemi(pentahydrate) (Alfa Aesar) is dissolved in 7 ml of water. Next, 18 grams of graphite powder (Superior Graphite Inc.) is impregnated with one of the metal nitrate solutions and dried overnight in air. The treated graphite is calcined at 300° C. for one hour under a nitrogen atmosphere in a programmable Barnstead THERMOLYNE 62700 furnace. The ramp rate is set at 5° C./minute. Calcination leads to decomposition of metal nitrate to metal oxide.

The metal oxide-coated graphite is ground in a pestle mortar and combined with 72 grams of milled BKO carbon powder (Barnaby and Suttcliffe), and 10 grams of guar gum. Further mixing is done in a Sigma blade mixer (Teledyne) for about an hour. Water is then added to convert the powder into plastic dough. Sufficient water is added to ensure that the plastic mix is stiff enough to hold its shape after extrusion. The moisture content of the dough at this stage is usually 42 to 43% (w/w). The dough is aged overnight in a sealed container at room temperature.

For extrusion, the plastic mix is loaded into the barrel of a batch extruder. One end of the barrel is fitted with an extrusion die for shaping the extrudate. The female extrusion die has a tapered surface to facilitate smooth flow of the plastic mass. The die has either five or seven slots and is 4.2 mm in diameter. An optional steel pin ensures a central passageway through the extrudate. A die pressure of 3000 lbs. is used for extrusion. The wet rods are placed on a well-ventilated tray for approximately one hour. The semi-dry rods are then carefully cut into 12 mm lengths while preserving the shape of the extrudate and the integrity of the axial hole. The fuel rods are dried overnight at room temperature.

Fuel elements from ECLIPSE brand cigarettes are carefully removed without disturbing the surrounding insulating glass mat. The test fuels are reinserted into the cigarette and smoked under 60/30/2 smoking conditions. Carbon monoxide in the mainstream is measured by NDIR as described above. Incorporation of cerium nitrate or copper nitrate in the fuel reduces the mainstream carbon monoxide by 38% and 46%, respectively, as compared to an untreated control.

Example 4

About 18 grams of graphite is treated with copper (II) nitrate hemi(pentahydrate) and calcined as described in Example 3. About 8 grams of the treated graphite is mixed with 10 grams of calcium carbonate (Alfa Aesar), 10 grams of guar gum, and 72 grams of milled BKO carbon. Further mixing is done in a Sigma blade mixer for about an hour. Water is then added to convert the powder into plastic dough. Sufficient water is added to ensure that the plastic mix is stiff enough to hold its shape after extrusion as described above. The moisture content of the dough at this stage is usually 42 to 43% (w/w). The dough is aged overnight in a sealed container at room temperature. The fuel rods are extruded, cut into 12 mm long pieces, and inserted in an ECLIPSE brand cigarette as described above. Carbon monoxide is measured by NDIR as described above. Incorporation of copper nitrate-treated graphite and calcium carbonate results in about 38% reduction in CO as compared to an untreated control.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method for making a fuel element for a smoking article, comprising:

mixing a metal-containing catalyst precursor with a filler material or graphite or a combination thereof to form a pre-treated fuel element component;

calcining the pre-treated fuel element component in order to convert the catalyst precursor to a catalytic metal compound;

after the calcining step, combining the pre-treated fuel element component with a carbonaceous material and a binder to produce a fuel element composition; and forming the fuel element composition into a fuel element adapted for use in a smoking article.

2. The method of claim 1, wherein the mixing step comprises mixing the metal-containing catalyst precursor with a particulate material selected from the group consisting of graphite particles, calcium carbonate particles, clay particles, and alumina particles.

3. The method of claim 1, wherein the calcining step comprises heating or irradiating the pre-treated fuel element component, under an inert atmosphere, at a temperature and for a time sufficient to convert the catalyst precursor to a catalytic metal compound.

4. The method of claim 3, wherein the calcining step comprises heating the pre-treated fuel element component at a temperature of between about 100° C. and about 600° C. for about 0.25 hour to about 8 hours.

5. The method of claim 1, further comprising incorporating a Group VIIIB catalytic metal into the fuel element or onto the surface thereof.

6. The method of claim 5, wherein said incorporating step comprises pre-treating the pre-treated fuel element component with the Group VIIIB catalytic metal.

7. The method of claim 5, wherein the Group VIIIB catalytic metal is selected from the group consisting of palladium, platinum, rhodium, halides thereof, and nitrates thereof.

8. The method of claim 1, wherein the binder is selected from the group consisting of guar gum, ammonium alginate, and sodium alginate.

9. The method of claim 1, wherein the forming step comprises extruding the fuel element mixture into a rod shape.

10. The method of claim 1, wherein the metal-containing catalyst precursor is in the form of a metal salt or an organic metal compound capable of thermal decomposition to a catalytic metal compound.

11. The method of claim 10, wherein the metal-containing catalyst precursor is in the form of a metal salt selected from the group consisting of citrates, nitrates, ammonium nitrates, sulfates, cyanates, hydrides, amides, thiolates, carbonates, and halides.

12. The method of claim 10, wherein the metal is selected from the group consisting of alkali metals, alkaline earth metals, transition metals in Groups IIIB, IVB, VB, VIB VIIB, VIIIB, IB, and IIB, Group IIIA elements, Group IVA elements, lanthanides, and actinides.

13. The method of claim 10, wherein the metal-containing catalyst precursor is selected from the group consisting of iron nitrate, copper nitrate, cerium nitrate, cerium ammonium nitrate, manganese nitrate, magnesium nitrate, zinc nitrate, and combinations thereof.

14. A method for making a fuel element for a smoking article, comprising:

mixing an aqueous solution of a metal-containing catalyst precursor with a particulate filler material or particulate graphite or a combination thereof to form a pre-treated fuel element component;

calcining the pre-treated fuel element component in order to convert the catalyst precursor to a catalytic metal compound;

after said calcining step, combining the pre-treated fuel element component with a carbonaceous material and a binder to produce a fuel element composition; and forming the fuel element composition into a fuel element adapted for use in smoking article.

15. The method of claim 14, wherein the mixing step comprises mixing the aqueous solution of the metal-containing catalyst precursor with a particulate material selected from the group consisting of graphite particles, calcium carbonate particles, clay particles, and alumina particles.

16. The method of claim 14, wherein the calcining step comprises heating or irradiating the pre-treated fuel element component, under an inert atmosphere, at a temperature and for a time sufficient to convert the catalyst precursor to a catalytic metal compound.

17. The method of claim 16, wherein the calcining step comprises heating the pretreated fuel element component at a temperature of between about 100° C. and about 600° C. for about 0.25 hour to about 8 hours.

18. The method of claim 14, further comprising pre-treating the pre-treated fuel element component with a Group VIIIB metal.

19. The method of claim 18, wherein the Group VIIIB catalytic metal is selected from the group consisting of palladium, platinum, rhodium, halides thereof, and nitrates thereof.

20. The method of claim 14, wherein the binder is selected from the group consisting of guar gum, ammonium alginate, and sodium alginate.

21. The method of claim 14, wherein the forming step comprises extruding the fuel element mixture into a rod shape.

22. The method of claim 14, wherein the metal-containing catalyst precursor is in the form of a metal salt or an organic metal compound capable of thermal decomposition to a catalytic metal compound.

23. The method of claim 22, wherein the metal-containing catalyst precursor is in the form of a metal salt selected from the group consisting of citrates, nitrates, ammonium nitrates, sulfates, cyanates, hydrides, amides, thiolates, carbonates, and halides.

24. The method of claim 14, wherein the metal-containing catalyst precursor is selected from the group consisting of iron nitrate, copper nitrate, cerium nitrate, cerium ammonium nitrate, manganese nitrate, magnesium nitrate, zinc nitrate, and combinations thereof.

* * * * *